US008777689B1

(12) United States Patent
Neal et al.

(10) Patent No.: US 8,777,689 B1
(45) Date of Patent: Jul. 15, 2014

(54) ENVIRONMENTALLY-RESPONSIVE TRANSFORMING VEHICLES

(76) Inventors: Phillip H. Neal, San Rafael, CA (US); Andrew Lewis Johnston, Redwood City, CA (US); Derek Garvens, San Francisco, CA (US); Scott Eckerman, Campbell, CA (US)

( * ) Notice: Subject to any disclaimer, the term of this patent is extended or adjusted under 35 U.S.C. 154(b) by 397 days.

(21) Appl. No.: 13/026,272

(22) Filed: Feb. 13, 2011

Related U.S. Application Data

(60) Provisional application No. 61/304,439, filed on Feb. 13, 2010.

(51) Int. Cl.
*A63H 17/40* (2006.01)

(52) U.S. Cl.
USPC ..... 446/441; 446/6; 446/130; 446/470

(58) Field of Classification Search
USPC ..... 446/4, 6, 130, 441, 444, 465, 470
See application file for complete search history.

(56) References Cited

U.S. PATENT DOCUMENTS

| | | | | | |
|---|---|---|---|---|---|
| 2,757,482 | A * | 8/1956 | Brown et al. | ..... | 446/6 |
| 2,803,920 | A * | 8/1957 | Salosky | ..... | 446/6 |
| 3,859,752 | A * | 1/1975 | Morrison et al. | ..... | 446/6 |
| 3,867,786 | A * | 2/1975 | Greenblatt | ..... | 446/130 |
| 3,959,920 | A * | 6/1976 | Ieda | ..... | 446/6 |
| 4,571,197 | A * | 2/1986 | Kulesza et al. | ..... | 446/6 |
| 4,911,669 | A * | 3/1990 | Parker | ..... | 446/6 |
| 4,940,444 | A * | 7/1990 | Russell | ..... | 446/446 |
| 5,322,469 | A * | 6/1994 | Tilbor | ..... | 446/454 |
| 5,380,231 | A * | 1/1995 | Brovelli | ..... | 446/6 |
| 5,676,582 | A * | 10/1997 | Lin | ..... | 446/130 |
| 5,702,107 | A * | 12/1997 | Novak | ..... | 273/442 |
| 5,713,783 | A * | 2/1998 | Szoke et al. | ..... | 446/456 |
| 5,816,886 | A * | 10/1998 | Cusolito | ..... | 446/444 |
| 5,816,888 | A * | 10/1998 | Myers | ..... | 446/456 |
| 5,906,528 | A * | 5/1999 | Ostendorff et al. | ..... | 446/6 |
| 5,916,007 | A * | 6/1999 | Maxim | ..... | 446/130 |
| 6,592,427 | B1 * | 7/2003 | Wilhelm et al. | ..... | 446/427 |
| 7,607,961 | B2 * | 10/2009 | Lorelli et al. | ..... | 446/454 |
| 7,674,150 | B2 * | 3/2010 | Hippely | ..... | 446/6 |
| 7,758,399 | B2 * | 7/2010 | Weiss et al. | ..... | 446/175 |
| 2003/0114072 | A1 * | 6/2003 | Judkins | ..... | 446/175 |

* cited by examiner

*Primary Examiner* — Gene Kim
*Assistant Examiner* — Joseph B Baldori
(74) *Attorney, Agent, or Firm* — Patent Law Offices of Michael E. Woods; Michael E. Woods

(57) ABSTRACT

A transforming toy vehicle, includes a chassis; a motive system coupled to the chassis translating a location of the chassis over a surface, the motive system including a free drive mode and an inhibited drive mode wherein the mode of the motive system establishes a state for a mode control latch, the mode control latch including a latched state and a not latched state; a housing, coupled to the chassis and responsive to the state of the mode control latch, the housing having an untransformed mode and a transformed mode, the housing transitioning from the untransformed mode to the transformed mode when the state of the mode control latch changes from the latched state to the unlatched state; and a detector, coupled to the chassis the motive system changing from the free drive mode to the inhibited drive mode when the carriage overlies the particular environmental feature wherein the housing transitions to the transformed mode.

19 Claims, 12 Drawing Sheets

ENVIRONMENTALLY-RESPONSIVE TRANSFORMING VEHICLES

BACKGROUND OF THE INVENTION

The present invention relates generally to amusement devices for children, and more particularly to an environmentally-responsive transforming vehicle.

There are many amusement systems and methods, particularly for children. A couple of classes of amusement systems that are perennially popular are vehicles and transformatives. It is well-known to provide transforming vehicles.

Many of these systems are manually transformable by manual manipulation from the user. There are some systems that provide an automatic transformation in response to some triggering event. Some systems vary an amount of randomness included in the triggering event Variation is important in amusement devices for children, so providing alternatives to triggering events is important, as well as providing alternatives to modalities for controlling the triggering events, including a degree of repeatability/predictability.

What is needed is a transformational toy vehicle responsive to a controllable repeatable environmentally-triggerable event.

BRIEF SUMMARY OF THE INVENTION

Disclosed are systems and methods for a transformational toy vehicle responsive to a controllable repeatable environmentally-triggerable event. An environmentally-responsive transforming toy vehicle, includes a chassis including an undercarriage; a motive system coupled to the chassis for translating a location of the chassis over a surface, the motive system including a free drive mode and an inhibited drive mode wherein the mode of the motive system establishes a state for a mode control latch, the state for the mode control latch including a latched state for the motive system in the free drive mode and a not latched state for the motive system in the inhibited drive mode; a housing, coupled to the chassis and responsive to the state of the mode control latch, the housing having an untransformed mode and a transformed mode, the housing transitioning from the untransformed mode to the transformed mode when the state of the mode control latch changes from the latched state to the unlatched state; and an environment feature detector, coupled to the undercarriage and moving uniformly over the surface when the motive system translates the location of the chassis, to detect when the undercarriage overlies a particular environmental feature, the motive system changing from the free drive mode to the inhibited drive mode when the carriage overlies the particular environmental feature wherein the housing transitions to the transformed mode when the chassis overlies the particular environmental feature.

A method for transforming a toy vehicle includes a) translating a toy vehicle over a surface including an environmental feature, the toy vehicle including a chassis having an undercarriage, a motive system coupled to the chassis for translating a location of the chassis over the surface, the motive system including a free drive mode and an inhibited drive mode wherein the mode of the motive system establishes a state for a mode control latch, the state for the mode control latch including a latched state for the motive system in the free drive mode and a not latched state for the motive system in the inhibited drive mode, and a housing, coupled to the chassis and responsive to the state of the mode control latch, the housing having an untransformed mode and a transformed mode, the housing transitioning from the untransformed mode to the transformed mode when the state of the mode control latch changes from the latched state to the unlatched state with an environmental feature detector coupled to the undercarriage and the translation moves the environmental feature detector relatively uniformly over the surface in the free drive mode; b) detecting the environmental feature using the environmental feature detector while the motive system is in the free drive mode; c) transitioning the motive system to the inhibited drive mode responsive to a detection of the environmental feature; d) transitioning the mode control latch to the unlatched state when the motive system is transitioned to the inhibited drive mode; and thereafter e) transforming the housing to the transformed mode responsive to the mode control latch transitioning to the unlatched state.

BRIEF DESCRIPTION OF THE DRAWINGS

FIG. 6 is a first latched state with a toy vehicle in a free drive mode;

FIG. 7 is the first latched state with the toy vehicle in an inhibited drive mode; and FIG. 8 is a first unlatched state with the toy vehicle in the inhibited drive mode illustrating initiation of a transformation of a housing.

FIG. 9 is a second latched state with a toy vehicle in a free drive mode;

FIG. 10 is the second latched state with the toy vehicle in an inhibited drive mode;

FIG. 11 is a second unlatched state with the toy vehicle in the inhibited drive mode illustrating initiation of a transformation of a housing;

DETAILED DESCRIPTION OF THE INVENTION

Embodiments of the present invention provide methods and systems enabling a transformational toy vehicle responsive to a controllable repeatable environmentally-triggerable event. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Figure 1:
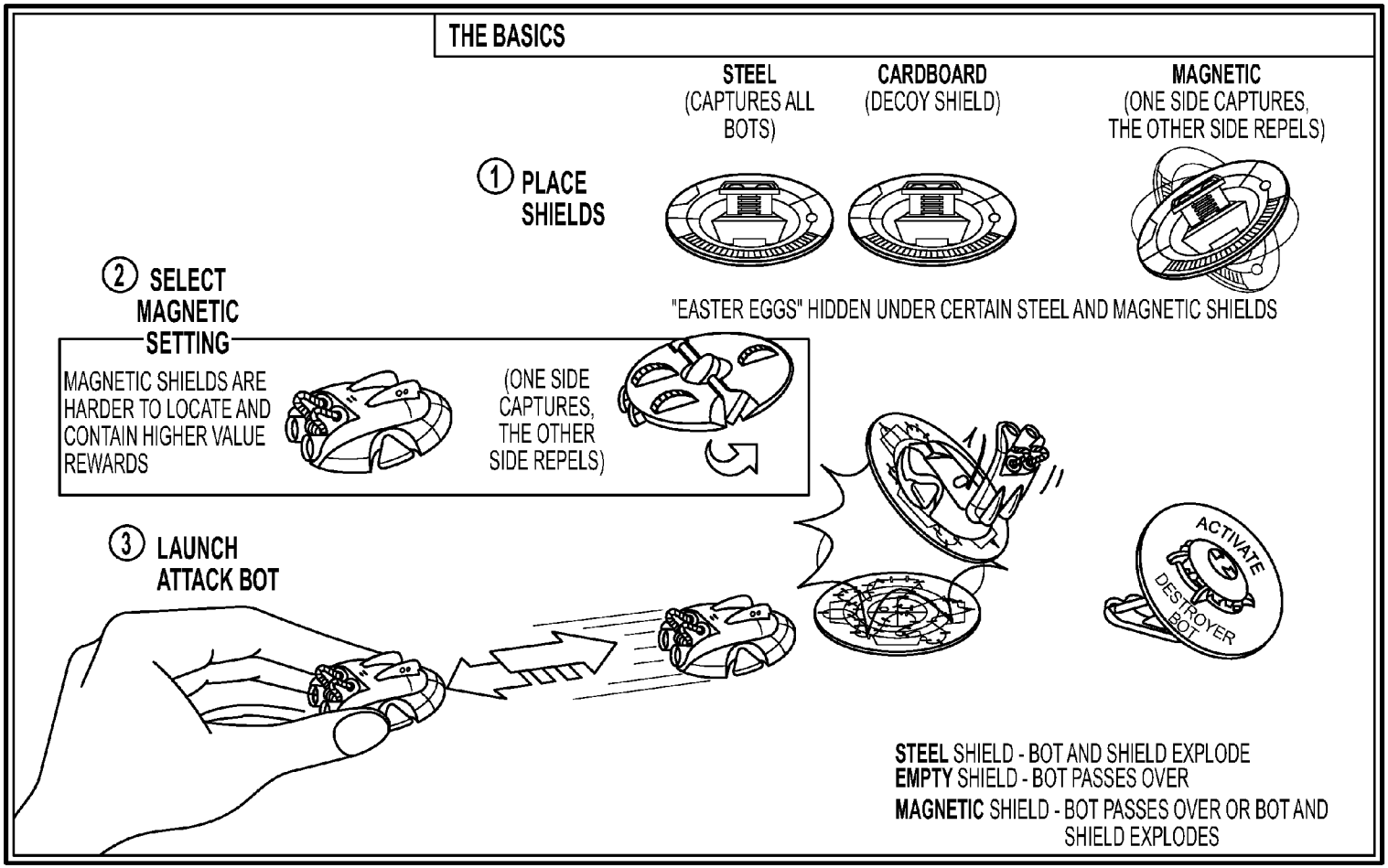
FIG. 1 is a general schematic diagram of an embodiment of the present invention including elements of a system employing transformational toy vehicles.

FIG. 1 is a general schematic diagram of an embodiment of the present invention using describing elements of a system employing transformational toy vehicles. In general, the embodiments of the present invention include transformational toy vehicles, an entertainment system using the vehicles, and a game collection paradigm.

As an overview, the vehicles include environmentally-triggerable transformation events, the game includes a multi-person competition implementation in which each person has elements of offense and defense turns following a setup/configuration phase. The setup/configuration includes placement of objects over a play surface, the objects may include one or more environmental features. Additionally, setup/configuration may include setting some environmental feature detection details of the toy vehicles. The play phase preferably includes alternating turns by the players. During play, the toy vehicles are launched towards a goal and the objects placed by the other players are designed to be impediments to achieving the goal. Various types of events occur as different vehicles encounter different objects until one player achieves the goal.

The preferred implementation uses magnets and magnetic materials for definition and detection of environmental features. An object may have general or specific magnetic characteristic and the toy vehicle interacts with the object based upon magnetic interactions (if any) between the placed object (s) and the toy vehicle. In a specific case, when a predefined transforming condition is detected between the object and the toy vehicle, the toy vehicle stops on the object and transforms.

In the preferred embodiment, the objects placed by the players are described as shields, and the embodiment shown in FIG. 1 includes three different types of shields (though other implementations may have a different number of shield types). The three types include a steel shield (captures all vehicles (also referred to herein as "bots")), a cardboard shield (decoy shield capturing no bots), and a magnetic shield (the shield exhibits a particular magnetic polarity and a bot is captured based upon a magnetic pole relationship between the shield polarity and a polarity of the environmental detector). The shields are thin planar objects that do not inhibit the bot from driving over an exposed face of the shield.

One aspect of the system is that of being a card collecting/trading game popular with some players. The shields and other elements of the system may have hidden collectability indicia (such as on an unexposed side of a shield) or gameplay adjustment directives, or "easter eggs" hidden on unexposed faces of one or more types of components, including shield faces that are turned "down" and hidden.

During the play phase, the players take turns launching one or more bots (which may have different characteristics and play features). There are many permutations of details relating to launching and strategies based upon bot type, shield placement, and goal specifics. However, one game play mechanic relates to interactions of the bot to the shields. When a bot drives over a particular shield, different events may occur. These events include the bot driving over the steel shield, the decoy (e.g., empty) shield, and the magnetic shield. When driving over the steel shield, the bot and shield "explode" (a simulated explosion in which the bot is captured on the shield and the vehicle transforms quickly—in the preferred embodiment the system is designed such that the simulated explosion occurs quickly and results in immobilizing the vehicle and revealing the previously hidden face of the shield). When driving over the decoy shield, the bot is not affected and continues its journey. When driving over the magnetic shield, the bot may "explode" or it may pass over unaffected, depending upon the orientations of the magnetic fields of the shield and the bot.

Figure 2:
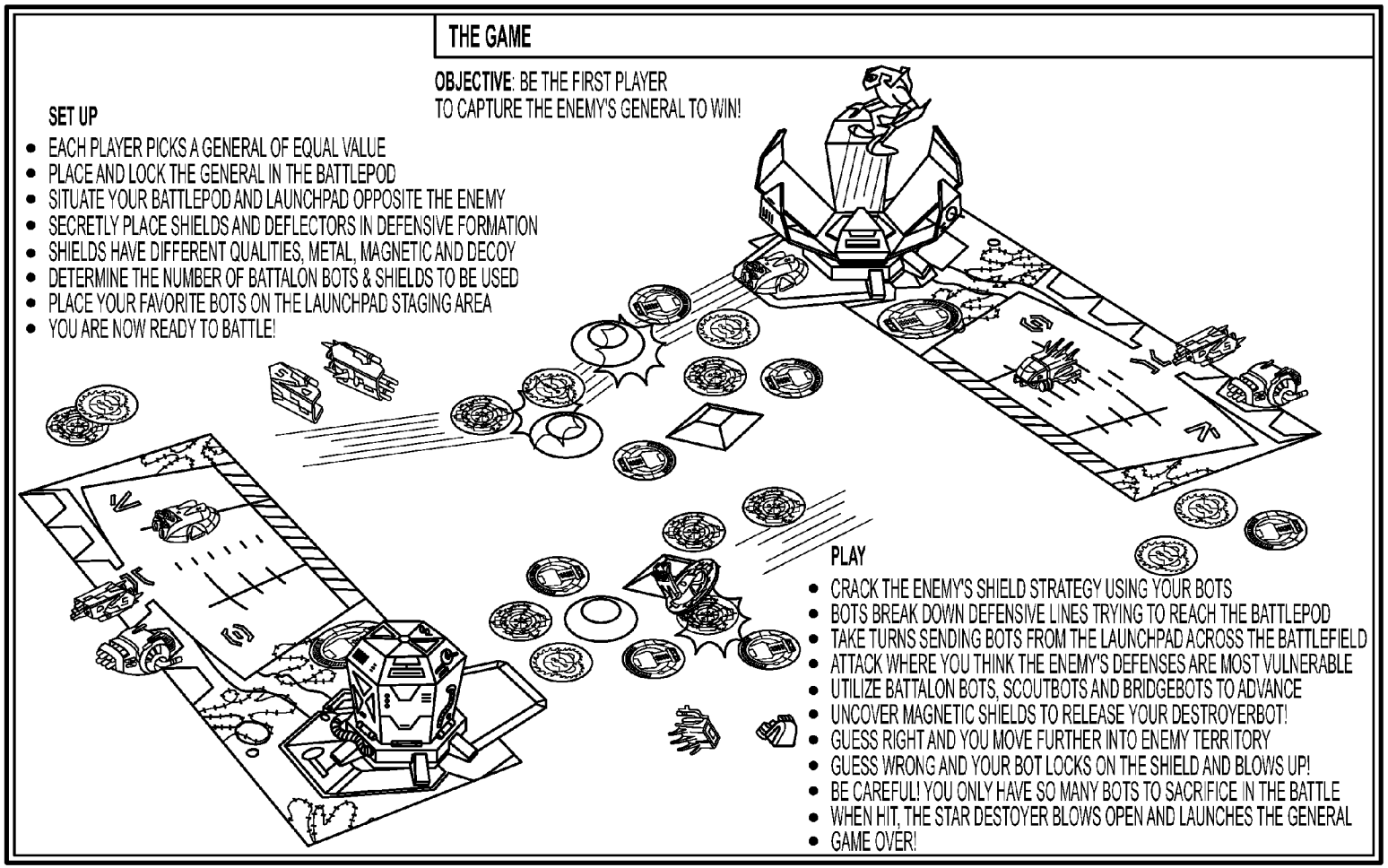
FIG. 2 is a general schematic description of an amusement system using the components of the system described in FIG. 1.

FIG. 2 is a general schematic description of an amusement system using the components of the system described in FIG. 1. The components of FIG. 1 are shown in one exemplary arrangement for one type of game, it being understood that many different games and arrangements are possible.

The specifics of the game shown in FIG. 2 include an objective, namely being the first player to capture a particular objective (e.g., the other player's general). There is a setup phase and a play phase. The setup includes each player: selecting a general; placing the general into a battlepod; arranging the playfield including orienting the launchpads opposite the other player's battlepod; deploying shields in a defensive formation between the other player's launchpad and your battlepod; establishing the troop makeup (e.g., select number and type of bots), battleplan, and rules of engagement.

The play phase includes aligning and launching the various types of transformational vehicles (the bots) against the other player's deployed shields. The various permutations of bots and shields result in probing, disarming, sacrificing one or more elements of your squad, all in an effort to have one of the bots reach the other player's battlepod. Reaching the battlepod with a bot by avoiding/overcoming/disabling the shields initiates a simulated explosion of the other player's battlepod which launches the other player's general-game/round over.

Figure 3:
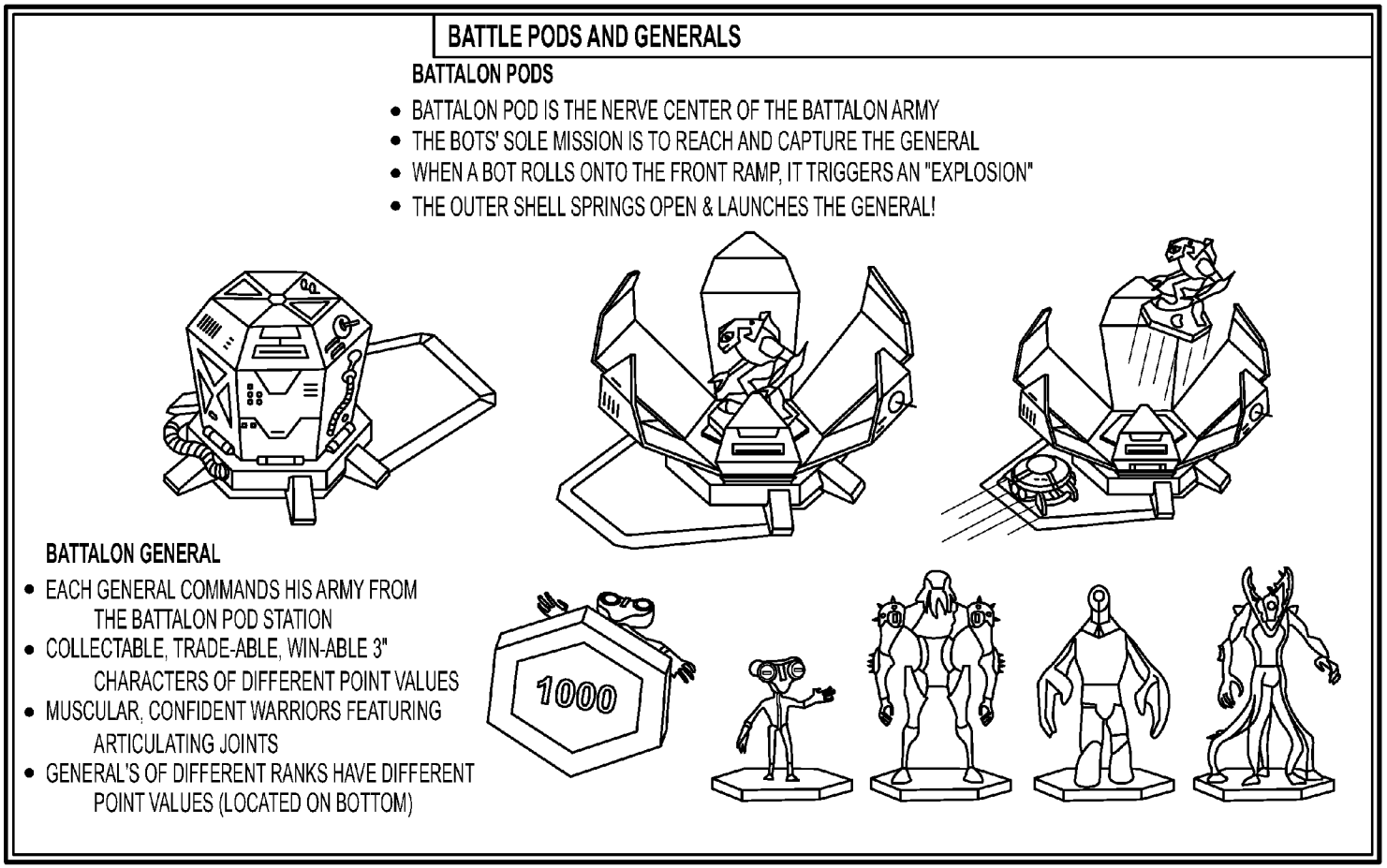
FIG. 3 is a general schematic description of some elements used in the system of FIG. 1.

FIG. 3 is a general schematic description of some elements used in the system of FIG. 1. The elements include battalon pods and battalon generals. Reaching the other player's pod is a main goal of the game. The pod is configured so that some event (e.g., a bot rolling up onto a front ramp) triggers a simulated explosion to spring open the battlepod and launch the general.

The generals are preferably configured to be collectable, trade-able, win-able figurines having different point values. They may be action figures and "ranks"—which may affect gameplay—such as number/configuration of offense and/or defense. Rank/value/information may be included on an underside of a base for the general.

Figure 4:
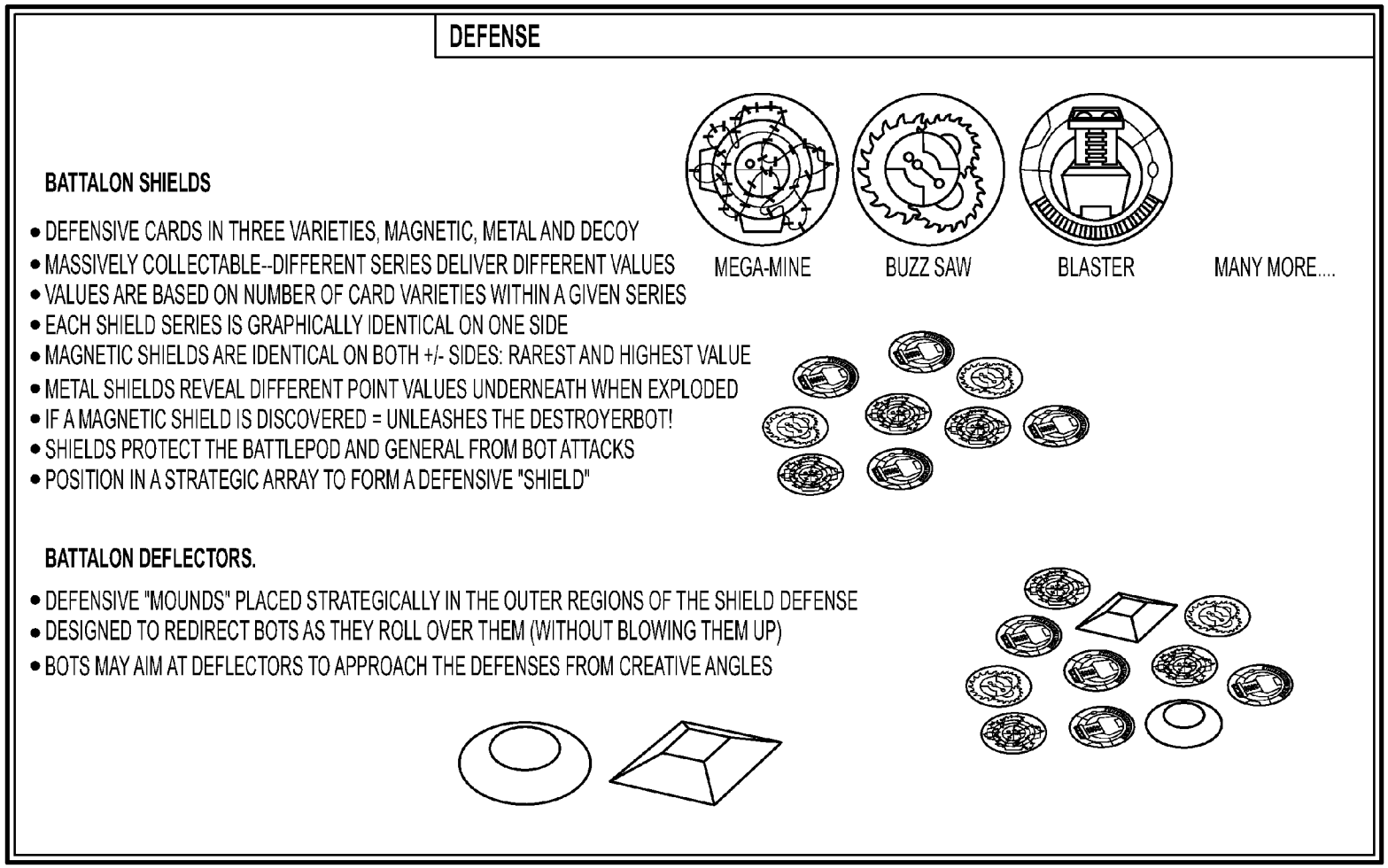
FIG. 4 is a general schematic description of environmental features used in the system of FIG. 1.

FIG. 4 is a general schematic description of environmental features used in the system of FIG. 1. The players have different types of elements available to them when configuring their defense. One type, the shields, have been described earlier. A second type of environmental feature, a deflector, is a mechanical interference that redirects a path of a bot as it moves over the play surface. Preferred deflectors include frustra of cones or pyramids, though other arrangements are possible.

Figure 5:
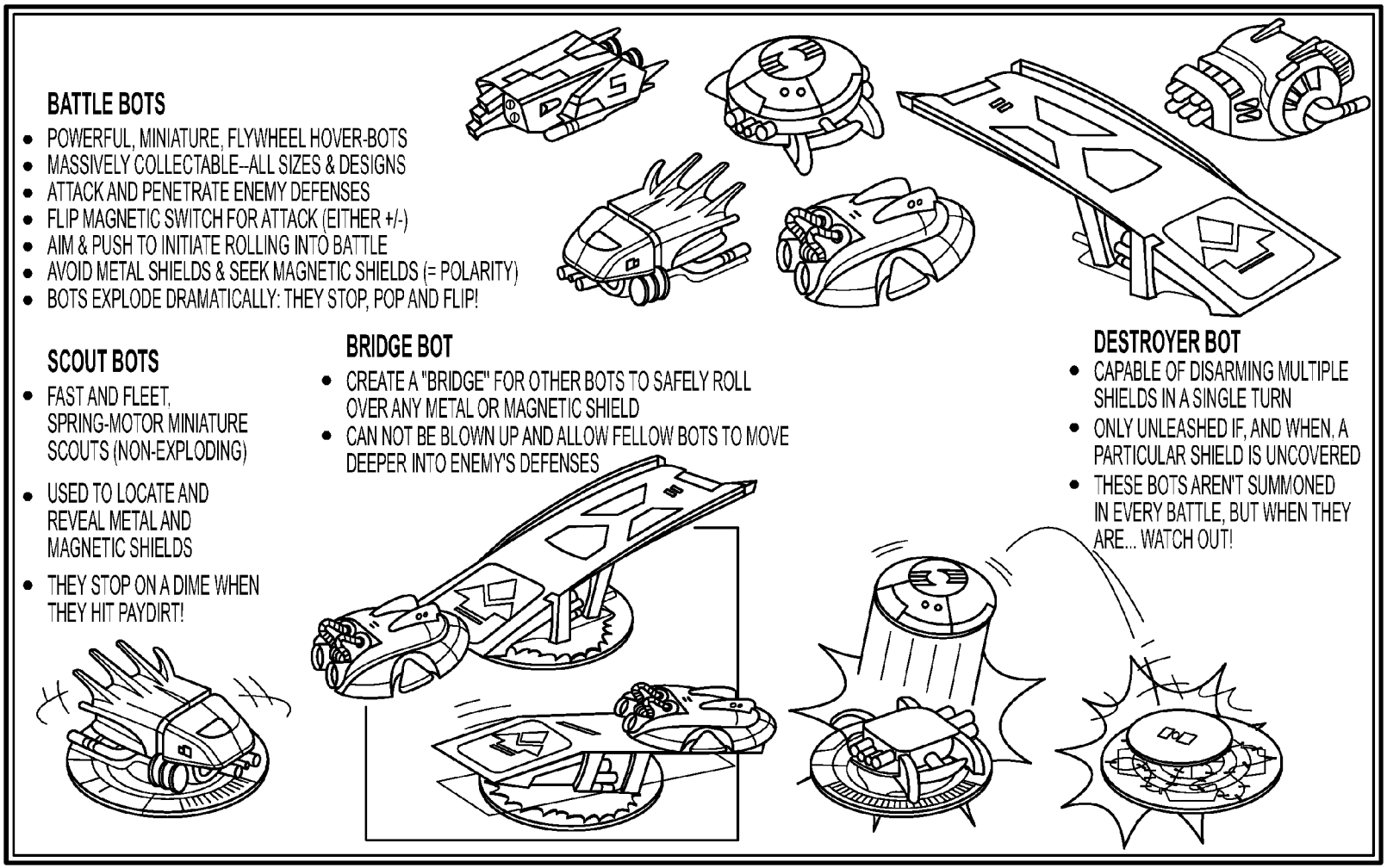
FIG. 5 is a general schematic description of selected operational features of transformational elements of the system of FIG. 1.

FIG. 5 is a general schematic description of selected operational features of transformational elements (e.g., some of the bots) useable with the system of FIG. 1. Bots may be of one of four general types: basic infantry bot (the battle bot), a scout bot, a bridge bot, and a destroyer bot.

The battle bot is a vehicle that move into/through the defenses and interact with the defensive elements based upon environmental interactions (magnetic fields/magnets). As noted above, the battle bot may pass over some of the shields and may simulate an explosion over other shield types.

The scout bot is a non-exploding bot that is used to reveal non-decoy shields.

The bridge bot is representative of a class of bots for overcoming some of the shield defenses. The bridge bot neutralizes a shield, permitting other bots to pass a particular shield placement.

The destroyer bot is a shield disarming bot that is designed to engage and neutralize one to several non-decoy shields at once. Multiple magnetic appendages attach and remove multiple shields.

Figure 6:
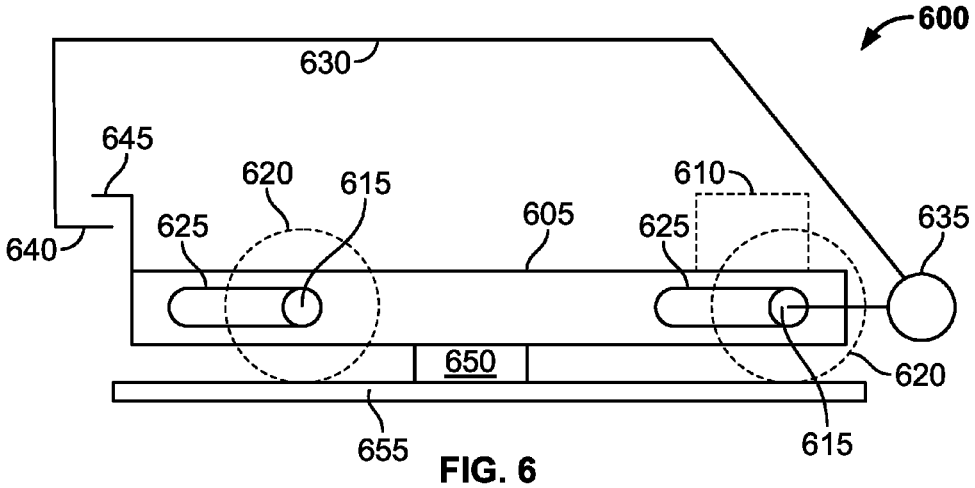
FIG. 6-FIG. 8 are a sequence of schematic block diagrams illustrating a first transforming arrangement for elements shown in FIG. 1.
Figure 7:
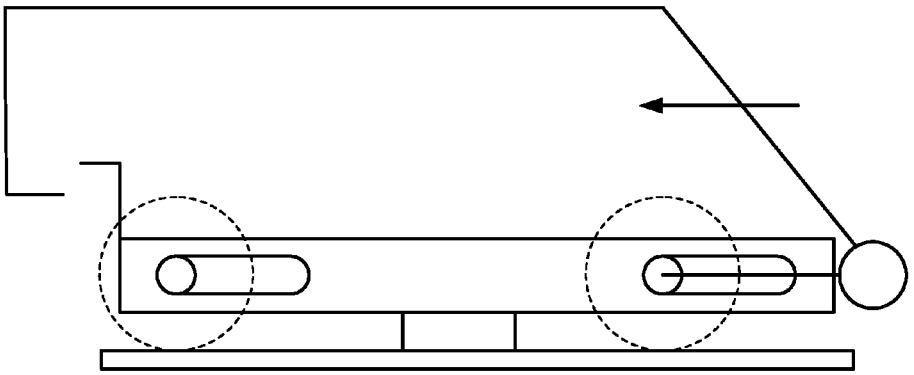
Figure 8:
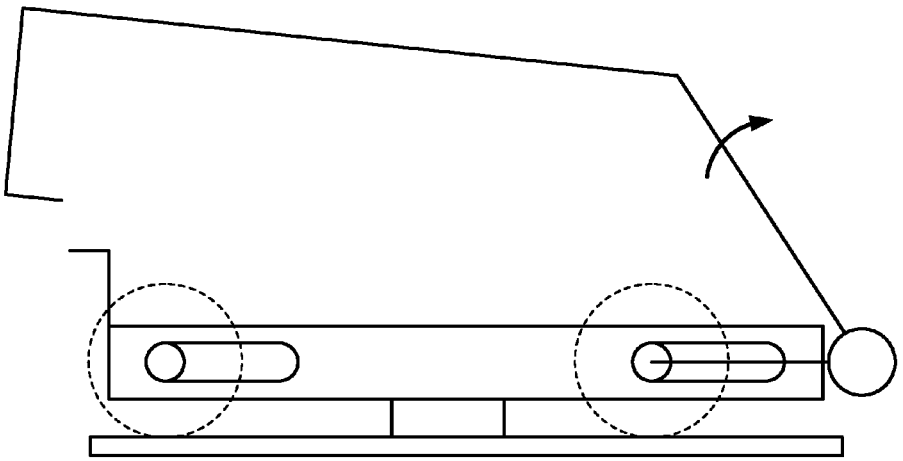

FIG. 6-FIG. 8 are a sequence of schematic block diagrams illustrating a first transforming arrangement for elements shown in FIG. 1. FIG. 6 is a first latched state with a toy vehicle 600 in a free drive mode. Vehicle 600 includes a chassis 605 supporting a motive source 610, one or more axles 615 supporting wheels 620 with axles 615 slidingly coupled to chassis 605 through one or more axle slots 625. A housing/cab 630 is springingly coupled to a pivot 635 coupled to one of axles 615. Cab 630 includes a latching member 640 complementary to a mating latching member 645 coupled to chassis 605. A magnet 650 acts as an environment feature detector and underlies chassis 650 to interact with an environment feature object 655 to selectably and controllably transform cab 630 as described herein. (Note that in FIG. 6 through FIG. 8, chassis 605 remains relatively fixed to object 655 while axle 615 and wheels 620 advance forward (shown advancing to the left).

Vehicle 600 is shown in a free drive mode with cab 630 in an untransformed mode (latched by a state of latching members 640 and 645). There are many types of motive sources 610 useful in the present invention, preferably a high-inertia flywheel type motor is used for the battle bots in order to provide sufficient power to implement the desired features. Some bots, such as the scout bot, may use a different motor, one enhanced for speed and lower torque.

FIG. 7 and FIG. 8 illustrate the transformation process of vehicle 600 (refer to FIG. 6 for element identification which have been removed from FIG. 7 and FIG. 8 to enhance understanding of the operation of the invention. To enhance controllability and repeatability of transformations of cab 630 as described below, magnet 650 is coupled to chassis 605 and wheels 620 are configured so that magnet 650 is moved relatively uniformly over a drive surface as motor 610 translates vehicle 600 over the drive surface. Some transforming systems mount a magnet near a periphery of a sphere, the sphere triggering a transformation when its magnet detects an object on the play surface. The distance of such a spherical periphery magnet above the surface when the sphere is rolled is not considered uniform as that term is used in the present invention (this is not only because the periphery magnet may not be on a great circle of rotation). Triggering predictability is harder to achieve the more that the magnet distance varies when the device moves over the surface.

When vehicle 600 drives over an appropriate environment feature object 655 (such as, for example a ferromagnetic material or the like, or a magnet of some type), magnet 650 engages object 655 when the orientations of the magnetic field of magnet 650 is attractant to object 655. This is the case for a magnetic material used in object 655 or for properly oriented magnetic poles when object 655 includes a magnet.

The engagement of magnet 650 to object 655 fixes a location of chassis 605 relative to object 655. Vehicle 600 is designed so that motor 610 continues to drive vehicle 600 forward while chassis 605 is held in place. This is referred to herein as the inhibited drive mode. Wheels 620 continue to move forward, which causes axles 615 to move forward, shifting within slot 625. In some embodiments, the wheels and surface of object 655 are configured to increase a "gripping" of the wheels to better enable the delatching as described herein. Cab 630 is coupled to axle 615, which means that latch member 640 also moves forward during drive inhibition mode. Complementary latch member 645, coupled to chassis 605 remains fixed relative to object 655. FIG. 7 illustrates a forward shift of cab 630 relative to chassis 605, which de-latches cab 630. FIG. 8 illustrates a transformation of cab 630 once de-latching has occurred (cab 630 is spring-biased at pivot 635 into the transformed position and held in the transformed state by the latching system. Delatching releases cab 630, responding to the spring bias in pivot 635, to transform. As shown, the beginning of the transformation mode causes cab 630 to swing up and back.

The preferred embodiments of the present invention use this transformation by providing a relatively strong bias and long arc movement of cab 635 during transformation. Preferably, this arc movement rotates pivot 635 more than ninety degrees, in some cases significantly past ninety degrees and closer to about one hundred eighty degrees when the transformation in complete. By providing a sufficiently strong bias in pivot 635 relative to the mass and configuration of cab 635 and chassis 605, the transformation is sudden and powerful. This movement simulates an "explosion" of vehicle 600, and is powerful enough to flip the over, at least one hundred eighty degrees, and sometimes more. Vehicle 600 is changed from the inhibited drive mode to an immobilized mode when vehicle 600 is flipped back and off of wheels 620. Since magnet 650 retains object 655 during the transformation, in the preferred embodiment this transformation flips vehicle 600 onto its back (exposing the undercarriage as well as a previously bottom face of object 655.

Figure 9:
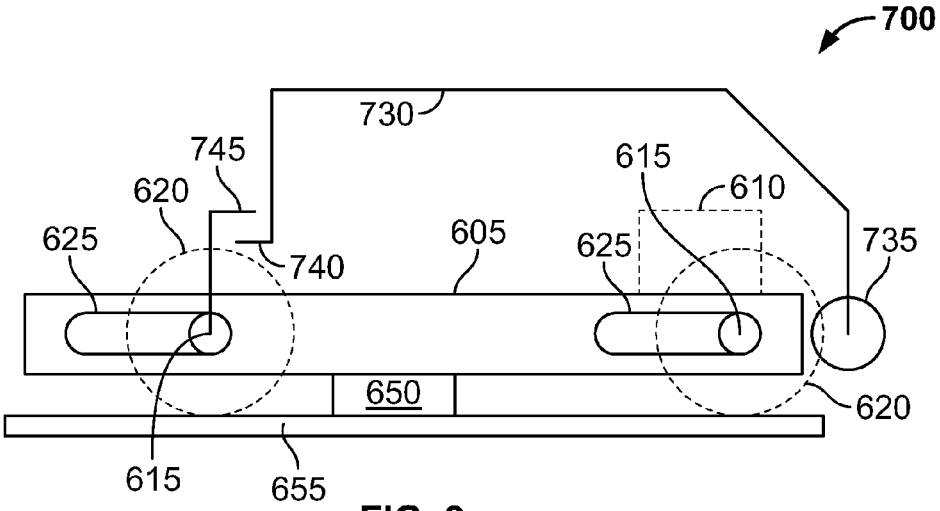
FIG. 9-FIG. 11 are a sequence of schematic block diagrams illustrating a second transforming arrangement for elements shown in FIG. 1.
Figure 10:
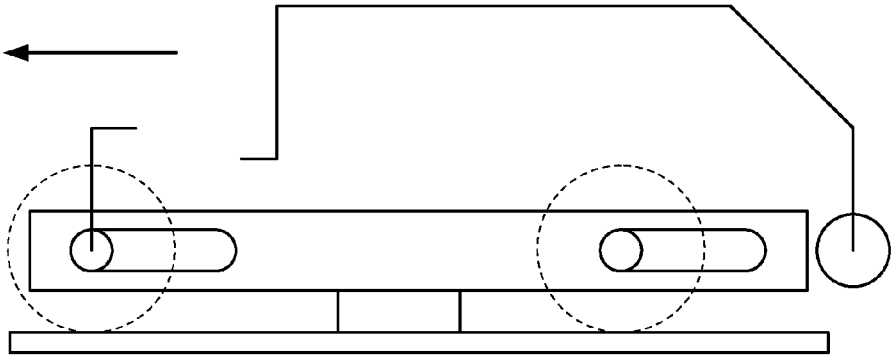
Figure 11:
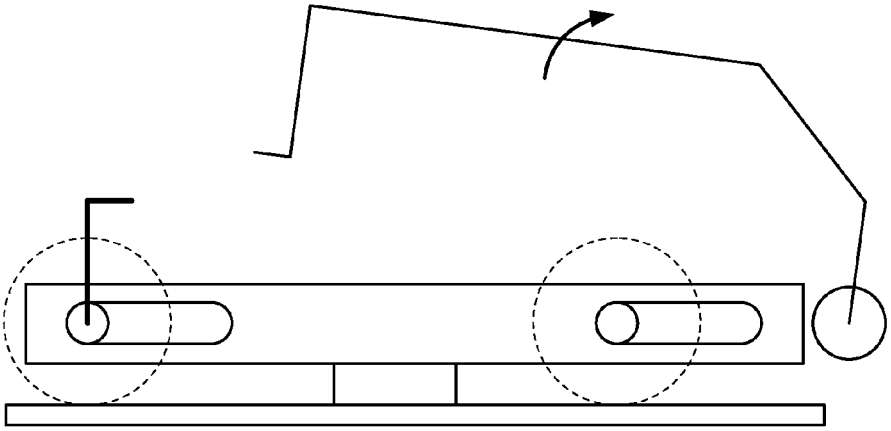

FIG. 9-FIG. 11 are a sequence of schematic block diagrams illustrating a second transforming arrangement for elements shown in FIG. 1, with like elements similarly numbered as in FIG. 6-FIG. 8. FIG. 9 is a first latched state with a toy vehicle 700 in a free drive mode. Vehicle 700 includes a chassis 605 supporting a motive source 610, one or more axles 615 supporting wheels 620 with axles 615 slidingly coupled to chassis 605 through one or more axle slots 625. A housing/cab 730 is springingly coupled to a pivot 735 coupled to chassis 605. Cab 730 includes a latching member 740 complementary to a mating latching member 745 coupled to one of axle 615. A magnet 650 acts as an environment feature detector and underlies chassis 605 to interact with an environment feature object 655 to selectably and controllably transform cab 730 as described herein. (Note that in FIG. 9 through FIG. 11, chassis 605 remains relatively fixed to object 655 while axle 615 and wheels 620 advance forward (shown advancing to the left).

Vehicle 700 is shown in a free drive mode with cab 730 in an untransformed mode (latched by a state of latching members 740 and 745). There are many types of motive sources 610 useful in the present invention, preferably a high-inertia flywheel type motor is used for the battle bots in order to provide sufficient power to implement the desired features. Some bots, such as the scout bot, may use a different motor, one enhanced for speed and lower torque.

FIG. 10 and FIG. 11 illustrate the transformation process of vehicle 700 (refer to FIG. 9 for element identification which have been removed from FIG. 10 and FIG. 11 to enhance understanding of the operation of the invention. To enhance controllability and repeatability of transformations of cab 730 as described below, magnet 650 is coupled to chassis 605 and wheels 620 are configured so that magnet 650 is moved relatively uniformly over a drive surface as motor 610 translates vehicle 700 over the drive surface.

When vehicle 700 drives over an appropriate environment feature object 655 (such as, for example a ferromagnetic material or the like, or a magnet of some type), magnet 650 engages object 655 when the orientations of the magnetic field of magnet 650 is attractant to object 655. This is the case for a magnetic material used in object 655 or for properly oriented magnetic poles when object 655 includes a magnet.

The engagement of magnet 650 to object 655 fixes a location of chassis 605 relative to object 655. Vehicle 700 is designed so that motor 610 continues to drive vehicle 700 forward while chassis 605 is held in place. This is referred to herein as the inhibited drive mode. Wheels 620 continue to move forward, which causes axles 615 to move forward, shifting within slot 625. In some embodiments, the wheels and surface of object 655 are configured to increase a "gripping" of the wheels to better enable the delatching as described herein. Latch 745 is coupled to axle 615, which means that latch member 745 also moves forward during drive inhibition mode. Complementary latch member 740, coupled to chassis 605 remains fixed relative to object 655. FIG. 10 illustrates a forward shift of latch 745 relative to chassis 605, which de-latches cab 730. FIG. 8 illustrates a transformation of cab 730 once de-latching has occurred (cab 730 is spring-biased at pivot 735 into the transformed position and held in the transformed state by the latching system. De-latching releases cab 730, responding to the spring bias in pivot 735, to transform. As shown, the beginning of the transformation mode causes cab 730 to swing up and back.

Figure 12:
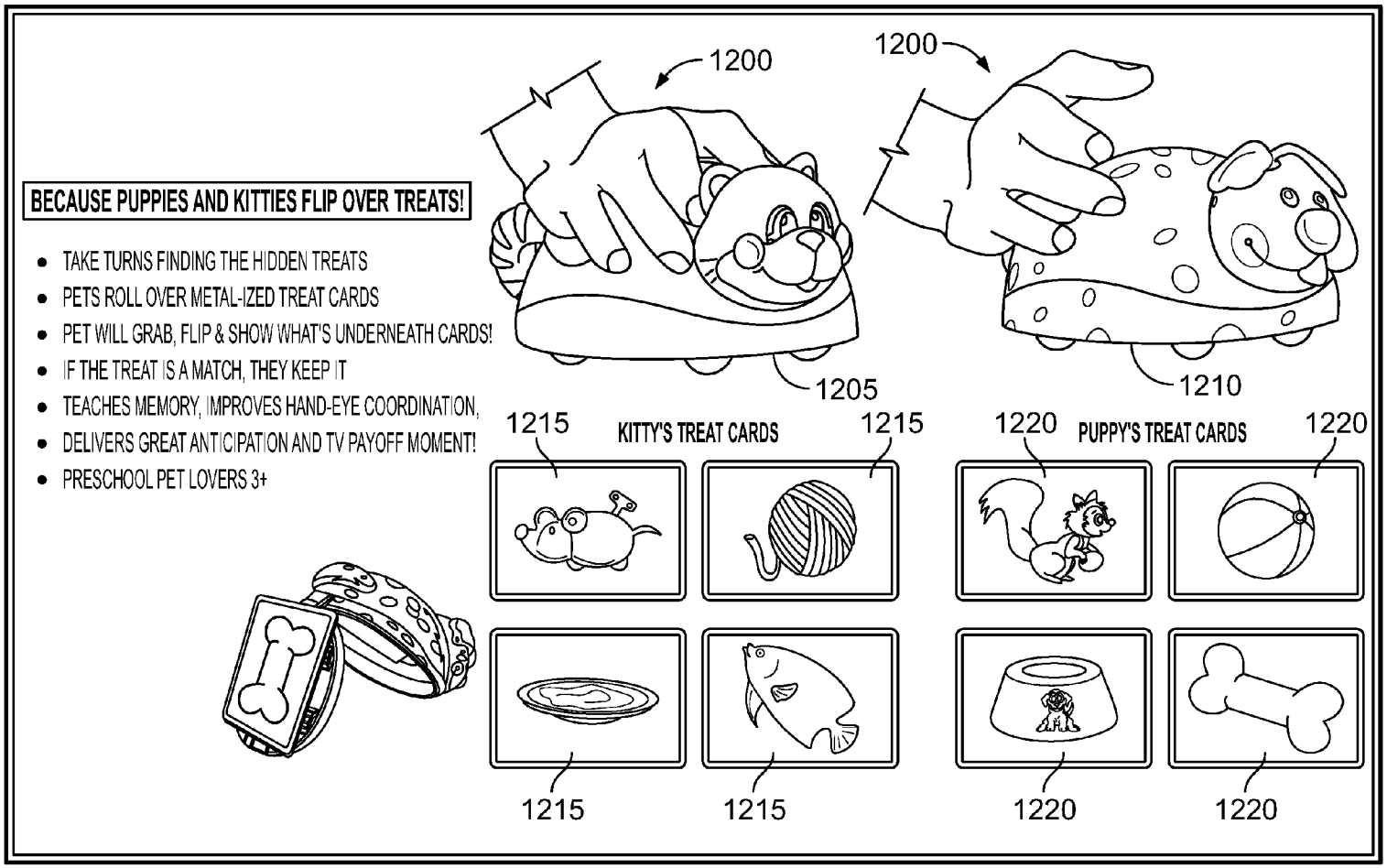
FIG. 12 is a general schematic diagram of an embodiment of the present invention including elements of a system employing transformational mobile amusement devices.

FIG. 12 is a general schematic diagram of an embodiment of the present invention including elements of a system employing transformational mobile amusement devices 1200. For example, they devices 1200 are themed as animals (though other simulated shapes interesting for the user may be used), specifically a "kitten" 1205 and a "puppy" 1210. This reflects that different housings may be used with the actuating mechanisms described herein. For this embodiment, there are a set of environment cards themed for each type of animal—for example a kitten-set 1215 for kitten device 1205 and a puppy-set 120 for puppy device 1210. Each card includes a composition reactive to the environmentally-responsive mechanism (e.g., a magnet) to engage and trigger the flipping actuation described herein.

Figure 13:
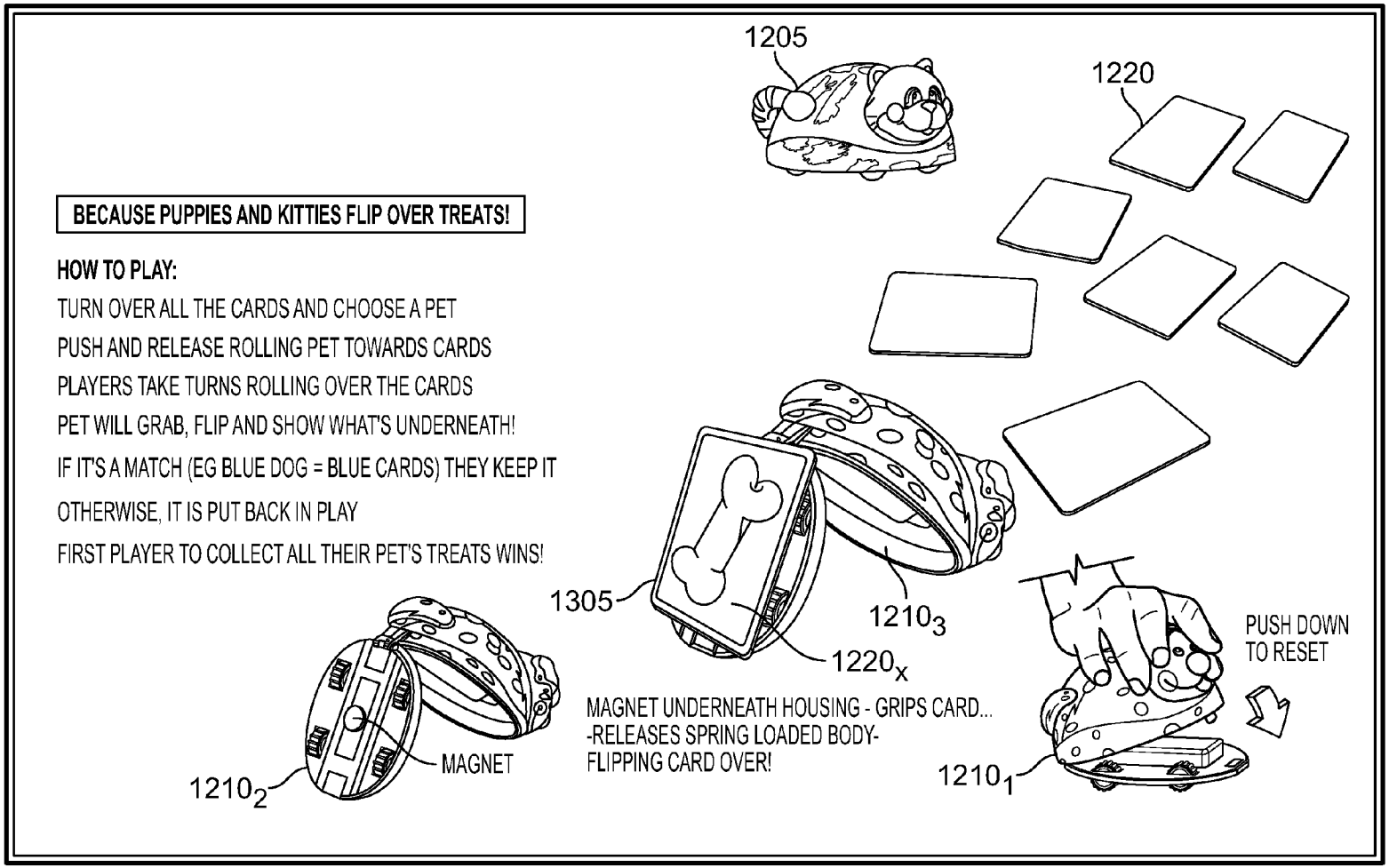
FIG. 13 illustrates a play methodology using the devices shown in FIG. 12.

FIG. 13 illustrates a play methodology using the devices shown in FIG. 12. A kitten device 1205 is shown as an alternative to the play sequence described using puppy device 1210. Cards of Puppy-set 1220 are distributed over a play surface. For multiplayer use, a preferred embodiment includes a distinguishing element (e.g., a color or the like) differentiating each player. For example, each card of puppy-set 1220 includes a border 1305 that has a color corresponding to one of the players. When device 1210 actuates and flips over a card, the border color is compared to the player's color and when there is a match, that player accumulates a score or other positive advancement/achievement (e.g., keep the card) during the play.

Briefly, a user resets the housing ($\mathbf{1210}_1$) and directs the vehicle over one of the cards of the cards distributed over the play surface. Each device has a deployed configuration after configuration (device $\mathbf{1210}_2$) in which a magnet holds a card $\mathbf{1220}_x$. Puppy device $\mathbf{1210}_3$ is shown in the deployed mode with a card $\mathbf{1220}_x$ from card-set 1220 attached to the magnet. By converting from $\mathbf{1210}_1$ to $\mathbf{1210}_2$ and holding a card $\mathbf{1220}_x$ (e.g., with the magnet), the card is flipped over and revealed in an exciting and amusing way engaging the attention and interest of the players. Some implementations may include audio/visual elements co-activated when the device transitions from $\mathbf{1210}_1$ to $\mathbf{1210}_2$.

Figure 14:
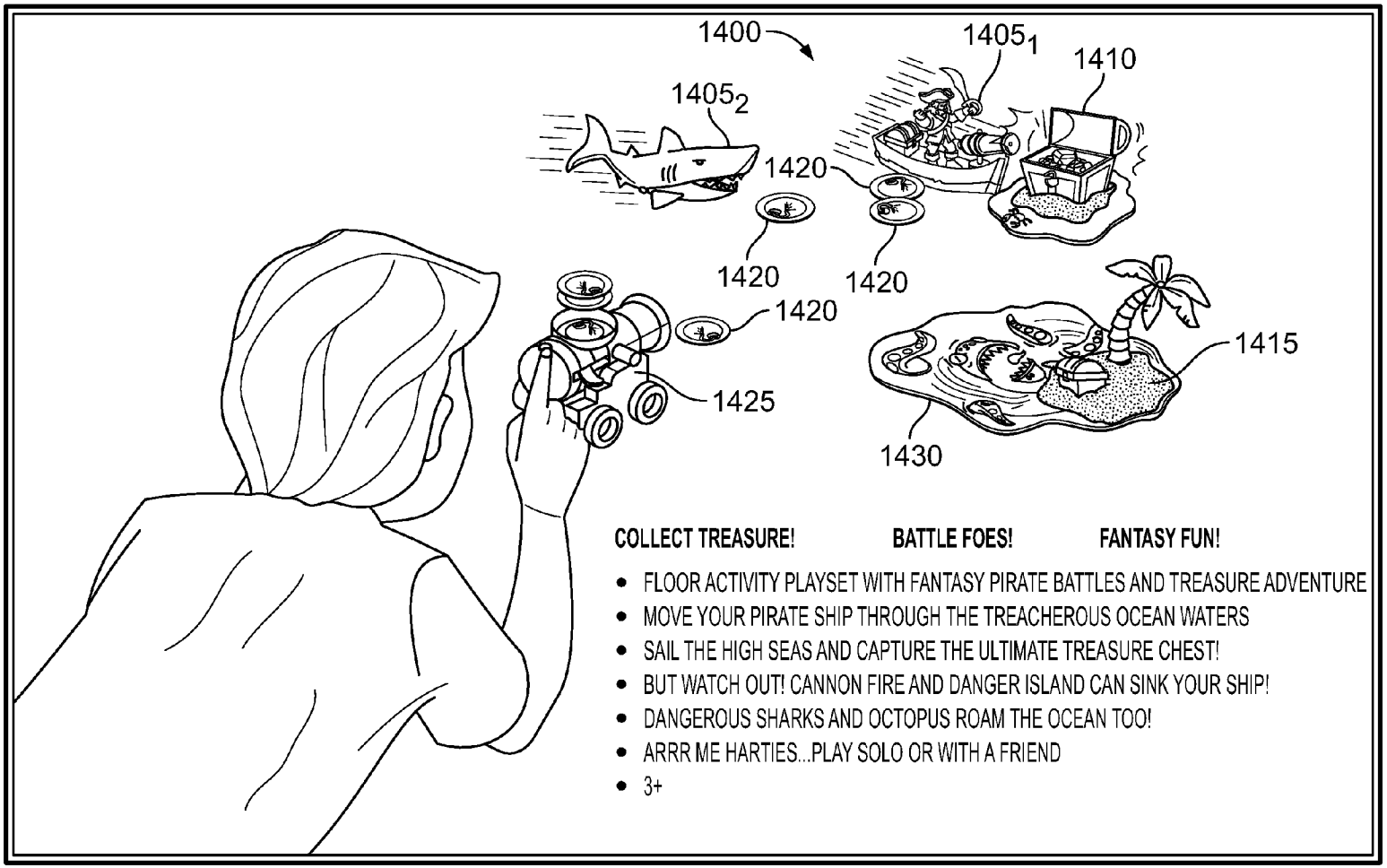
FIG. 14 illustrates another alternative implementation of the present invention incorporated into a "pirate" themed amusement set.

FIG. 14 illustrates another alternative implementation of the present invention incorporated into a "pirate" themed amusement set 1400. Elements of set 1400 include one or more mobile transformational devices 1405, a goal 1410, a stationary obstruction, a set of launchable obstructions 1420, and a launcher 1425 for directing and ejecting obstructions 1420. The components are commonly themed, in this case with the pirate them. Device 14051 is the player's play piece that, in the preferred play style, operated to reach goal 1410 (themed as a treasure chest). Over the play surface, there are various obstructers including the stationary obstructor 1415 that includes a reactive surface 1430.

Advantageously in some optional implementations, device 14051 includes an element to trigger a "success" indication when device 14051 successfully comes "close enough" (including contact) to goal 1410. (For example a trigger mounted in a forward element of device 14051.) However, device 14051 will "sink" (depicted as the flip/deployed mode described elsewhere herein) when encountering certain of the obstructers. For example, device 14051 entering over surface 1430 of stationary obstructor 1415 will flip and be delayed/prevented from reaching goal 1410.

The launchable and mobile obstructers 1420 may be used by an opponent of the player to try and interject one of the obstructers 1420 between device 14051 and goal 1410. In this case, launchable obstructers 1420 are depicted as cannonballs and launcher 1424 as a cannon. The obstructers 1420 are each reactive with the triggering mechanism of device 1405, so when the user properly interjects the mobile obstructor into the path, device 1405 will be triggered and be delayed/prevented from reaching goal 1410.

Another optional mobile obstructor is shown as obstructor 14052, depicted as a shark. Mobile obstructor 14052 may interact with device 14051 in various ways, but one preferred way is to physically alter the path trajectory by contact between the devices 1405. A consequence of providing a mobile obstructor in this fashion is that it is also responsive to the launchable obstructers 1420 that may be used to counter the attack by mobile obstructor 14052 on device 14051.

Figure 15:
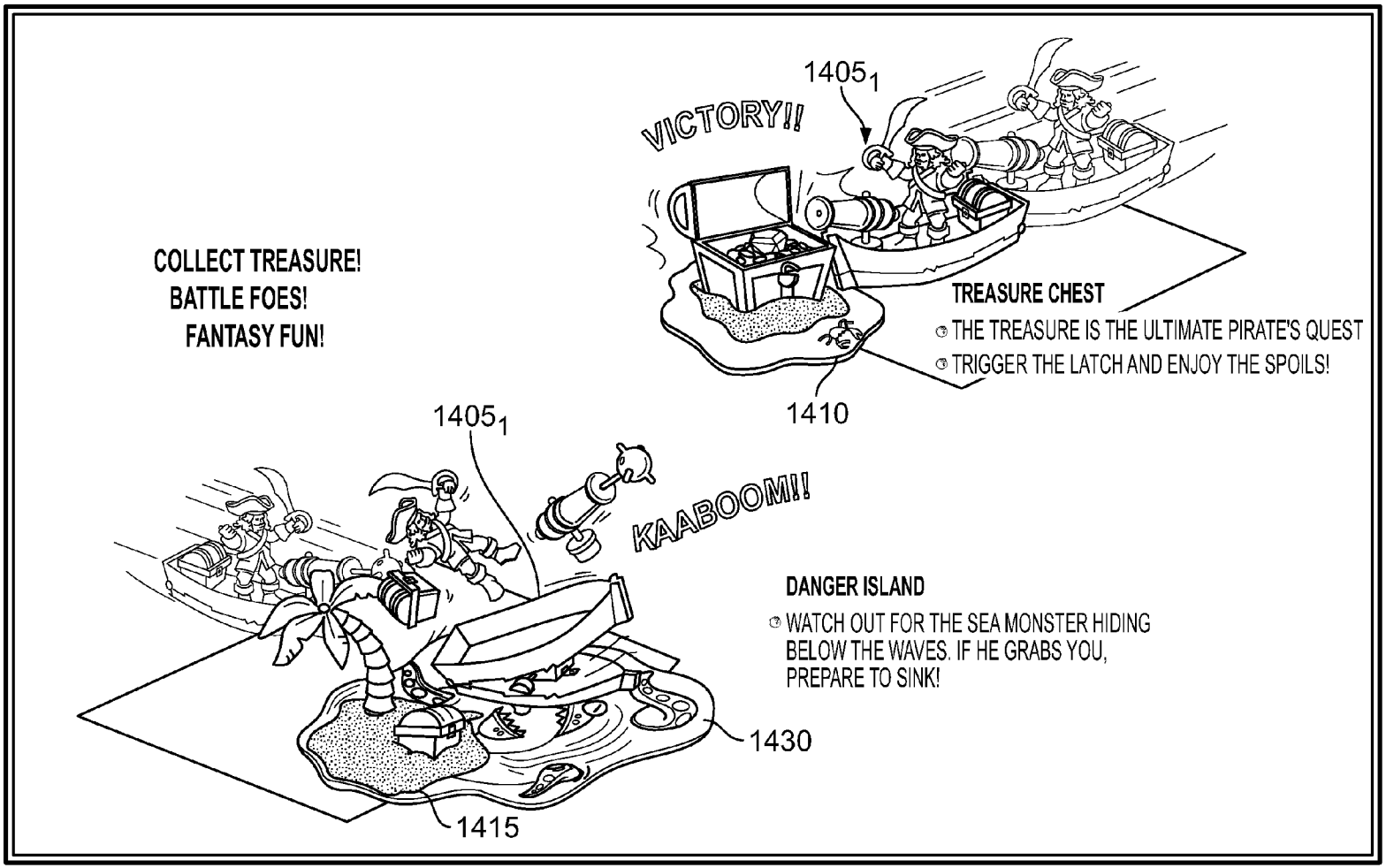
FIG. 15 illustrates some component details of the amusement set shown in FIG. 14.
Figure 16:
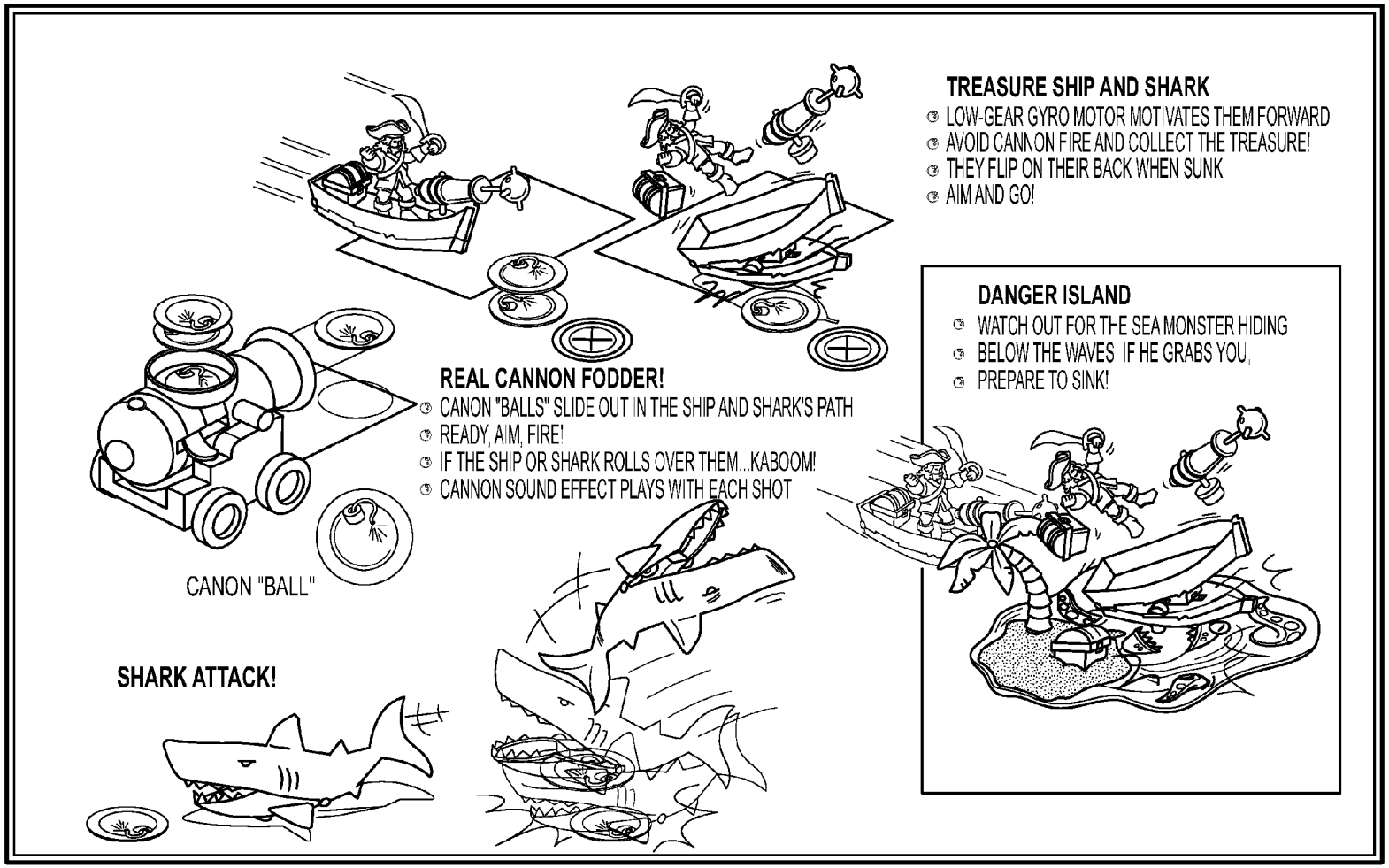
FIG. 16 illustrates an exemplary play methodology for the amusement set shown in FIG. 14 and FIG. 15.

FIG. 15 illustrates some component details of the amusement set shown in FIG. 14 and FIG. 16 illustrates an exemplary play methodology for the amusement set shown in FIG. 14 and FIG. 15. The devices and environmental elements (e.g., the cards/obstructers) shown in FIG. 12-FIG. 16 are preferably implemented without the rotatable/configurable magnetic polarity modes described herein. However, it should be noted that by using this optional element, it would be possible to provide "cannonballs" of different polarities such that the "shark" obstructor would respond to one set and the "ship" device would respond to a different set for a different play style.

The preferred embodiments of the present invention use this transformation by providing a relatively strong bias and long arc movement of cab 735 during transformation. Preferably, this arc movement rotates pivot 735 more than ninety degrees, in some cases significantly past ninety degrees and closer to about one hundred eighty degrees when the transformation in complete. By providing a sufficiently strong bias in pivot 735 relative to the mass and configuration of cab 735 and chassis 605, the transformation is sudden and powerful. This movement simulates an "explosion" of vehicle 700, and is powerful enough to flip the vehicle over, at least one hundred eighty degrees, and sometimes more. Vehicle 700 is changed from the inhibited drive mode to an immobilized mode when vehicle 700 is flipped backwards and off of wheels 620. Since magnet 650 retains object 655 during the transformation, in the preferred embodiment this transformation flips vehicle 700 onto its back (exposing the undercarriage as well as a previously bottom face of object 655.

The system above has been described in the preferred embodiment of a mechanical transformational toy vehicle responsive to a controllable repeatable environmentally-triggerable event. Various features, elements, and subsystems of the present invention, including the system, method, and equivalent computer program products for the embodiments described in this application may, of course, be embodied in other hardware; e.g., within or coupled to a Central Processing Unit ("CPU"), microprocessor, microcontroller, System on Chip, or any other programmable device. Additionally, the system, method, and computer program product, may be embodied in software (e.g., computer readable code, program code, instructions and/or data disposed in any form, such as source, object or machine language) disposed, for example, in a computer usable (e.g., readable) medium configured to store the software. Such software enables the function, fabrication, modeling, simulation, description and/or testing of the apparatus and processes described herein. For example, this can be accomplished through the use of general programming languages (e.g., C, C++), GDSII databases, hardware description languages (HDL) including Verilog HDL, VHDL, AHDL (Altera HDL) and so on, or other available programs, databases, nanoprocessing, and/or circuit (i.e., schematic) capture tools. Such software can be disposed in any known computer usable medium including semiconductor (Flash, or EEPROM, ROM), magnetic disk, optical disc (e.g., CD-ROM, DVD-ROM, etc.) and as a computer data signal embodied in a computer usable (e.g., readable) transmission medium (e.g., carrier wave or any other medium including digital, optical, or analog-based medium). As such, the software can be transmitted over communication networks including the Internet and intranets. A system, method, computer program product, and propagated signal embodied in software may be included in a semiconductor intellectual property core (e.g., embodied in HDL) and transformed to hardware in the production of integrated circuits. Additionally, a system, method, computer program product, and propagated signal as described herein may be embodied as a combination of hardware and software.

One of the preferred implementations of the present invention is as a routine in an operating system made up of programming steps or instructions resident in a memory of a computing system as well known, during computer operations. Until required by the computer system, the program instructions may be stored in another readable medium, e.g. in a disk drive, or in a removable memory, such as an optical disk for use in a CD ROM computer input or other portable memory system for use in transferring the programming steps into an embedded memory used in the device. Further, the program instructions may be stored in the memory of another computer prior to use in the system of the present invention and transmitted over a LAN or a WAN, such as the Internet, when required by the user of the present invention. One skilled in the art should appreciate that the processes controlling the present invention are capable of being distributed in the form of computer readable media in a variety of forms.

Any suitable programming language can be used to implement the routines of the present invention including C, C++, Java, assembly language, etc. Different programming techniques can be employed such as procedural or object oriented. The routines can execute on a single processing device or multiple processors. Although the steps, operations or computations may be presented in a specific order, this order may be changed in different embodiments. In some embodiments, multiple steps shown as sequential in this specification can be performed at the same time. The sequence of operations described herein can be interrupted, suspended, or otherwise controlled by another process, such as an operating system, kernel, and the like. The routines can operate in an operating system environment or as stand-alone routines occupying all, or a substantial part, of the system processing.

In the description herein, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

A "computer-readable medium" for purposes of embodiments of the present invention may be any medium that can contain, store, communicate, propagate, or transport the program for use by or in connection with the instruction execution system, apparatus, system or device. The computer readable medium can be, by way of example only but not by limitation, an electronic, magnetic, optical, electromagnetic, infrared, or semiconductor system, apparatus, system, device, propagation medium, or computer memory.

A "processor" or "process" includes any human, hardware and/or software system, mechanism or component that processes data, signals or other information. A processor can include a system with a general-purpose central processing unit, multiple processing units, dedicated circuitry for achieving functionality, or other systems. Processing need not be limited to a geographic location, or have temporal limitations. For example, a processor can perform its functions in "real time," "offline," in a "batch mode," etc. Portions of processing can be performed at different times and at different locations, by different (or the same) processing systems.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

Embodiments of the invention may be implemented by using a programmed general purpose digital computer, by using application specific integrated circuits, programmable logic devices, field programmable gate arrays, optical, chemical, biological, quantum or nanoengineered systems, components and mechanisms may be used. In general, the functions of the present invention can be achieved by any means as is known in the art. Distributed, or networked systems, components and circuits can be used. Communication, or transfer, of data may be wired, wireless, or by any other means.

It will also be appreciated that one or more of the elements depicted in the drawings/figures can also be implemented in a more separated or integrated manner, or even removed or rendered as inoperable in certain cases, as is useful in accordance with a particular application. It is also within the spirit and scope of the present invention to implement a program or code that can be stored in a machine-readable medium to permit a computer to perform any of the methods described above.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the United States is:

1. A transforming toy vehicle responsive to a moveable magnet-responsive feature disposed on a drive surface, comprising:

a chassis including an undercarriage, a forward axle slot and a rearward axle slot, said undercarriage including a detector disposed between said axle slots, said detector including a responsive element magnetically-responsive to the moveable magnet-responsive feature;

a motive system moveably coupled to said chassis with said motive system including a forward axle moveably coupled within said forward axle slot and a rearward axle moveably coupled within said rearward axle slot, said motive system configured to translate a location of said detector relatively uniformly over the drive surface in a drive direction and over the moveable magnet-responsive feature, said motive system including a free drive mode and an inhibited drive mode wherein said mode of said motive system is adapted to establish a state for a mode control latch, said state for said mode control latch including a latched state when said motive system is in said free drive mode and in a first orientation relative to said chassis and a not latched state when said motive system is in said inhibited drive mode and in a second orientation relative to said chassis different from said first orientation;

a housing, rotatably coupled to said chassis and responsive to said state of said mode control latch, said housing having an untransformed mode and a transformed mode, said housing transitioning from said untransformed mode to said transformed mode when said state of said mode control latch changes from said latched state to said unlatched state;

a latching mechanism, responsive to said mode control latch, including a first latch element coupled to said housing and a second latch element complementary to said first latch element and selectively engageable with said first latch element, said latching mechanism including a latched mode configured to hold said housing in said untransformed mode as long as said second latch element engages said first latch element and said latching mechanism including a released mode configured to release said housing from said untransformed mode wherein said housing rotatably transforms to said transformed mode responsive to said biasing mechanism;

wherein said detector is configured to respond to the moveable magnet-responsive feature when said motive system positions said chassis and said detector over the moveable magnet-responsive feature, said detector engaging the moveable magnet-responsive feature and coupling said chassis to the moveable magnet-responsive feature while said motive system continues to move over the drive surface relative to said chassis after coupling of said responsive element with the moveable magnet-responsive feature, with said motive system adapted to move said axles relative to said chassis from said free drive mode to said inhibited drive mode and releasing said latch elements.

2. The vehicle of claim 1 wherein said motive system includes an axle slot and an axle moveably coupled to said chassis within said axle slot with said axle moving within said axle slot from a first position relative to said chassis in said free drive mode to a second position relative to said chassis in said inhibited drive mode.

3. The vehicle of claim 2 wherein said environment feature detector includes a magnetic material generating a magnetic field and wherein said particular environmental feature is an object interacting with said magnetic field.

4. The vehicle of claim 3 wherein said magnetic material includes a first magnet having a north pole and a south pole.

5. The vehicle of claim 4 further comprising a mount, coupled to said undercarriage, for holding said magnet with said poles generally oriented perpendicular to said surface.

6. The vehicle of claim 5 wherein said mount selects a particular orientation for said poles of said magnet.

7. The vehicle of claim 6 wherein said mount includes two selectable orientations for said magnet, said selectable orientations including a first orientation having said south pole closer to said surface than said north pole and a second orientation having said north pole closer to said surface than said south pole.

8. The vehicle of claim 7 wherein said housing is spring-loaded to transition rapidly to said transformed mode.

9. The vehicle of claim 8 wherein said rapid transition of said housing generates sufficient momentum to flip said chassis to an immobile state where said motive system is effectively disengaged from translating said chassis over said surface, said immobile state exposing said undercarriage.

10. The vehicle of claim 9 wherein said object is integrated into a light-weight planar card over which said motive system may translate said chassis.

11. The vehicle of claim 10 wherein said object includes a second magnet interacting with said first magnet.

12. The vehicle of claim 11 wherein said second magnet includes a north pole and a south pole and wherein said planar card includes two selectable orientations for said second magnet, said selectable orientations including a first orientation having said south pole closer to said surface than said north pole and a second orientation having said north pole closer to said surface than said south pole.

13. The vehicle of claim 12 wherein said particular environmental feature includes said first magnet and said second magnet having matching selected orientations.

14. The vehicle of claim 13 wherein said planar card has a first face and a second face with said first face exposed when said planar card is disposed on said surface, said chassis translating over said first face.

15. The vehicle of claim 14 wherein said planar card is secured to said undercarriage using said magnets when said selected orientations are different.

16. The vehicle of claim 15 wherein said second face is exposed when said chassis is in said immobile state.

17. A transforming toy responsive to a magnet-responsive region of a drive surface, comprising:

a motive source;

a chassis supporting said motive source and including an elongate first axle slot having a first end and a second end;

a first axle, coupled to said motive source and moveably coupled relative to said chassis producing a drive mode, said drive mode including a first drive configuration and a second drive configuration, said first axle extending through said first axle slot and shifting relative to said chassis from said first end in said first drive configuration to said second end in said second drive configuration;

a plurality of motive elements coupled to said first axle, said motive elements supporting said chassis over the drive surface;

a housing rotatably coupled to said chassis and having a repeatable rotation relative to said chassis from a first transformation mode to a second transformation mode and having a repeatable rotation relative to said housing from said second transformation mode to said first transformation mode, said housing including a biasing mechanism biasing a transformation of said housing towards said second transformation mode from said first transformation mode;

a latching mechanism, responsive to said drive mode, including a first latch element coupled to said housing and a second latch element complementary to said first latch element and selectively engageable with said first latch element, said latching mechanism including a latched mode configured to hold said housing in said first transformation mode as long as said second latch element engages said first latch element and said latching mechanism including a released mode configured to release said housing from said first transformation mode wherein said housing rotatably transforms to said second transformation mode responsive to said biasing mechanism; and a detector including a responsive element magnetically-responsive to the magnet-responsive region coupled to an underside of said chassis proximate the drive surface, said responsive element configured to couple the magnet-responsive region to said chassis when said motive source moves said chassis overlying the magnet-responsive region wherein said motive source is configured to relatively move said chassis and said first axle when said responsive element couples the magnet-responsive region which changes said drive mode from said first drive configuration to said second drive configuration;

said motive source is configured to drive said chassis and said detector relatively uniformly over the drive surface;

wherein a first one latch element of said latch elements is coupled to said chassis and a second one latch element of said latch elements different from said first one latch element is coupled to said first axle; and wherein said latching mechanism is in said latched mode in said first drive configuration and in said released mode in said second drive configuration.

18. The transforming toy of claim 17 wherein said chassis is positioned between said housing and the drive surface in a first vehicle orientation during said first drive configuration, wherein said biasing mechanism is configured to flip said housing relative to said chassis from said first vehicle orientation to a second vehicle orientation responsive said second drive configuration, and wherein said housing is positioned between said chassis and said drive surface in said second vehicle orientation.

19. The transforming toy of claim 18 wherein the magnet-responsive region includes a first magnet-responsive material provided within a moveable planar card disposed on the drive surface, said moveable planar card having a first side facing away from the drive surface and a second side facing toward the drive surface, wherein said responsive element includes a second magnet-responsive material, at least one of said magnet-responsive materials including a magnet, said second magnet-responsive material engaging said first magnet-responsive material and securing said first side to said chassis in said first vehicle orientation wherein said second side faces away from the drive surface in said second vehicle orientation.

* * * * *